US005794926A

United States Patent [19]

Hansch

[11] Patent Number: 5,794,926

[45] Date of Patent: Aug. 18, 1998

[54] DEVICE FOR OPENING PRINTED PRODUCTS AND APPARATUS FOR PROCESSING PRINTED PRODUCTS

[75] Inventor: Egon Hansch, CH-Wetzikon, Switzerland

[73] Assignee: Ferag AG, Hinwil, Switzerland

[21] Appl. No.: 586,196

[22] Filed: Jan. 12, 1996

[30] Foreign Application Priority Data

Jan. 13, 1995 [CH] Switzerland ..... 101/95

[51] Int. Cl.[6] ..... B65H 39/00

[52] U.S. Cl. ..... 270/52.26

[58] Field of Search ..... 270/52.26, 52.27, 270/52.28, 52.29, 52.3

[56] References Cited

U.S. PATENT DOCUMENTS

| | | | |
|---|---|---|---|
| 4,279,412 | 7/1981 | Glatz . | |
| 4,489,930 | 12/1984 | Meier . | |
| 4,684,116 | 8/1987 | Hansch . | |
| 4,684,117 | 8/1987 | Honegger et al. | 270/52.26 |
| 5,100,118 | 3/1992 | Hobb et al. | 270/52.26 |
| 5,248,135 | 9/1993 | Leu . | |
| 5,292,110 | 3/1994 | Honegger | 270/52.26 |
| 5,292,111 | 3/1994 | Hansch | 270/54 |
| 5,324,014 | 6/1994 | Honegger et al. . | |
| 5,350,167 | 9/1994 | Hansch . | |
| 5,354,043 | 10/1994 | Resit . | |
| 5,377,965 | 1/1995 | Mandel et al. | 270/52.26 |
| 5,377,967 | 1/1995 | Eberle . | |
| 5,425,837 | 6/1995 | Hansch . | |
| 5,462,266 | 10/1995 | Meier . | |
| 5,474,285 | 12/1995 | Stauber . | |

FOREIGN PATENT DOCUMENTS

| | | |
|---|---|---|
| 0 208 081 | 1/1987 | European Pat. Off. . |
| 667 859 | 11/1988 | Switzerland . |
| 684 085 | 7/1994 | Switzerland . |
| 1 086 397 | 10/1967 | United Kingdom . |

*Primary Examiner*—John T. Kwon
*Attorney, Agent, or Firm*—Brinks Hofer Gilson & Lione

[57] ABSTRACT

A device for opening printed products having a carrying body rotatable about an axis and a flow duct subjected to negative pressure. An adapter such as a suction head or a pneumatically controllable gripper is mounted in the carrying body and connected to the flow duct.

13 Claims, 6 Drawing Sheets

DEVICE FOR OPENING PRINTED PRODUCTS AND APPARATUS FOR PROCESSING PRINTED PRODUCTS

BACKGROUND OF THE INVENTION

The present invention relates to a device for opening printed products and to an apparatus for processing printed products.

A device and an apparatus of this type are disclosed in the CH Patent Application No. 02 667/94-2. The apparatus has a wheel-like conveying device with clamps which are arranged one behind the other with respect to the direction of rotation. Each clamp has a clamp jaw for seizing a folded printed product at its fold and for feeding the folded printed product to a processing station with the leading open side edge of the printed product in front. A device for opening printed products is provided upstream of the processing station in order to open the printed products fed by the conveying device. As a result, the printed products can be deposited in a straddling manner on saddle-like rests of the processing station. The device for opening the printed products includes an opening assembly with a rotatable opening roller and a suction head disposed in the roller. The suction head is connected through a valve arrangement to a negative-pressure source for a specific rotational range of the opening roller. The suction head comes to rest against the outer side of one part of the folded printed products and lifts the product part off from the other product part. This device is suitable, in particular, for opening folded sheets which each have a single-leaf product part. However, the central opening of printed products with multiple-leaf product parts is not possible with the known device since the suction head can reliably secure only the outermost leaf of a product part. This applies at least as long as the printed products in question are not double-fold printed products.

A device for the central opening of folded printed products, whose product parts each include a number of sheets, is disclosed, for example, in U.S. Pat. No. 5,292,111 and the corresponding EP-A-0 518 063. This device includes a rotatable opening roller with opening protuberances that can be moved back and forth in a controlled manner in a radial direction. The opening protuberances grip the sheets of the product part facing the opening roller in the border region which is located opposite the fold. As a result, the printed product is opened. Running in the interior of each gripper is a flow duct that can be connected to a positive-pressure source when the gripper is closed in order to blow air into an air jet located between the retained product part and the other product part. This arrangement assists the two product parts in being lifted off from one another during opening. One product part of the printed products includes a border region or overfold that projects beyond the other product part. If the printed products are conveyed with that product part which includes the border region facing the opening device, the border region is clamped between an opening protuberance and the opening roller. As a result, the product part which includes the border region is secured in order for the printed product to be opened. If, in contrast, the products are conveyed with the shorter product part facing the opening device, an opening protuberance grips beneath the border region of the other product part and lifts the border region. The opening protuberance then clamps in the shorter product part between it and the opening roller in order for the printed product to be opened. Printed products without an overfold cannot be opened by means of this device.

Accordingly, an object of the present invention is to provide a device for opening printed products and an apparatus for processing printed products that are suitable for opening and processing different printed products.

SUMMARY OF THE INVENTION

The present invention provides a device for opening printed products that includes a carrying body, a flow duct, and an adaptor. The carrying body is rotatable about an axis and the flow duct is subjected to negative pressure for a rotational position of the carrying body. The adaptor is mounted in the carrying body and connected to the flow duct.

The present invention also provides an apparatus for processing printed products that includes a conveying device, a device for opening the printed products, and a processing station. The conveying device has a plurality of clamps for conveying the printed products. The device for opening the printed products includes a rotatable carrying body, a flow duct subjected to negative pressure for a rotational position of the carrying body, and an adaptor mounted in the carrying body and connected to the flow duct. Finally, the processing station has a plurality of rests for receiving the opened printed products in a straddling manner.

Since a suction head and a pneumatically controllable gripper are arranged in a mutually exchangeable manner on a carrying body, the device and the apparatus of the present invention can also be adapted in optimum fashion This results in an extremely low degree of outlay for the type of printed products that are to be processed. The negative pressure that is necessary for the functioning of the suction head is also used for controlling the gripper, thus contributing to an extremely simple construction of the device and apparatus.

BRIEF DESCRIPTION OF THE DRAWINGS

The present invention will now be explained in more detail below with reference to the drawings.

DETAILED DESCRIPTION

Figure 1:
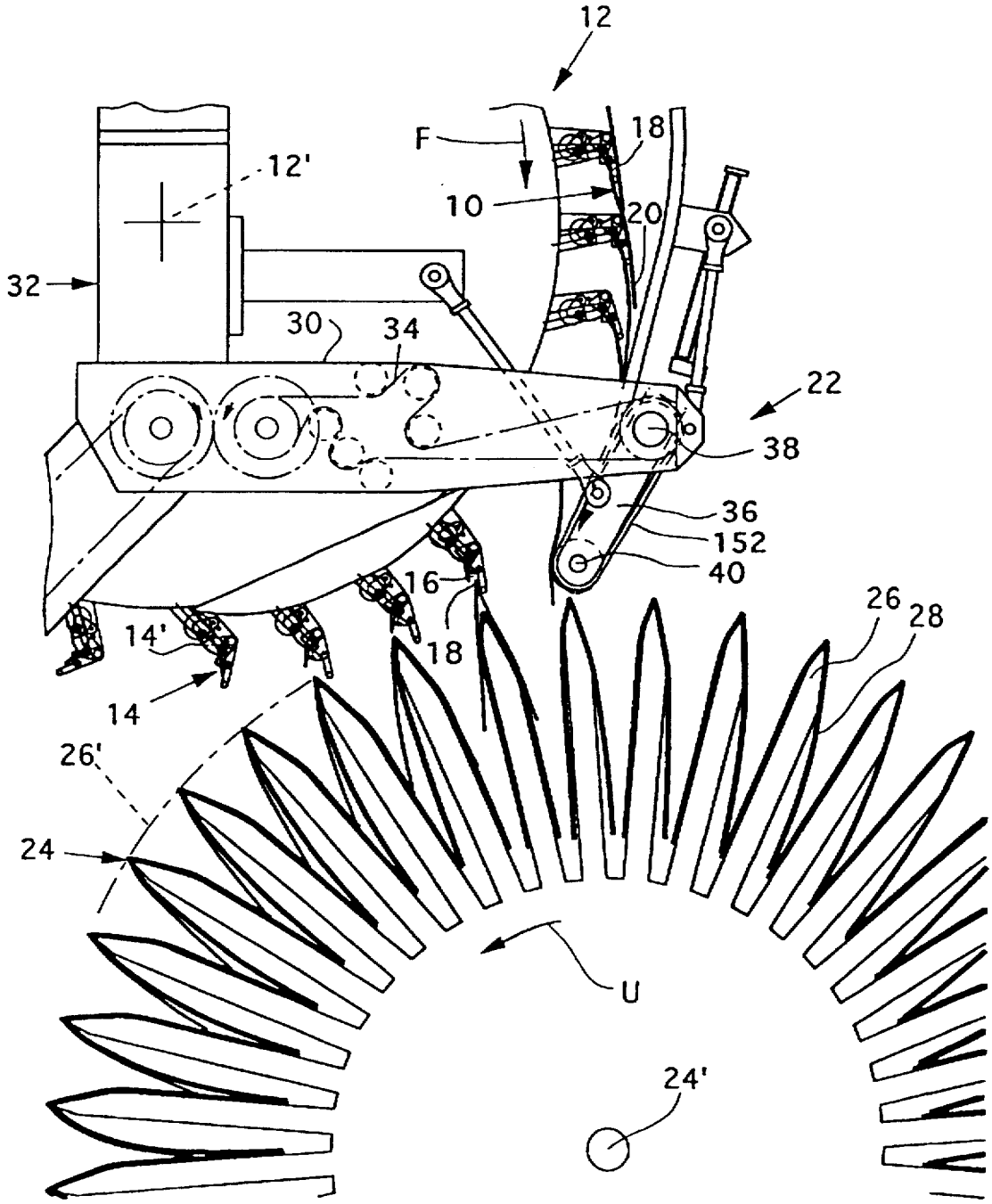
FIG. 1 shows a partial view of an apparatus for processing printed products, having a conveying device for feeding printed products to a processing station and a device for opening the printed products.

The apparatus shown in FIG. 1 for processing printed products 10 includes a wheel-like conveying device 12 with individually controllable transporting clamps 14 that are arranged one behind the other, with a respect to the conveying direction F. The spacing of the transporting clamps 14 and their pivoting position about a pivot axis 14' parallel to the axis of rotation 12' can be controlled individually, as is described and shown in detail in CH Patent Application No. 02 667/94-2 The construction and mode of function of the conveying device 12 is the same as the conveying device described and shown in detail in CH Patent Application No. 02 667/94-2. Each transporting clamp has a clamp jaw 16 directed approximately to the front with respect to the conveying direction F. The clamp jaw 16 retains a folded printed product 10 at its fold 18 and feeds it past an opening device 22 to a processing station 24 with the open edge 20, located opposite the fold 18, in front. The processing station is provided with saddle-like rests 26 that are arranged in the manner of a drum around a common axis of rotation 24'. The saddle-like rests rotate in a direction of rotation U along a continuous rotary path 26'. The printed products 10 that are opened by the opening device 22 are allowed to drop when the clamps are opened and rest on the saddle-like rests in a straddling manner. If printed products 28 that are already folded are present on the saddle-like rests 26, the printed products 10 are deposited in a straddling manner on the printed products 28.

The opening device 22 is arranged on an extension-like carrier 30 of a machine framework 32. The conveying device 12 is also mounted on said framework. The opening device 22 is connected to a drive motor (not shown) by means of a schematically indicated chain drive 34 and is synchronized both with the conveying device 12 and with the processing station 24.

The opening device 22 includes two parallel bearing plates 36 arranged on the carrier 30. A drive shaft 38 and a hollow shaft 40 parallel to the drive shaft are mounted on the bearing plates 36 in a rotatable manner. A chain wheel 42 is wedged on the hollow shaft 40 and a chain 42' is guided around the chain wheel. The chain 42' is connected to the chain drive 34 and drives the hollow shaft 40 in a direction of rotation D around its longitudinal axis 40'.

Figure 3:
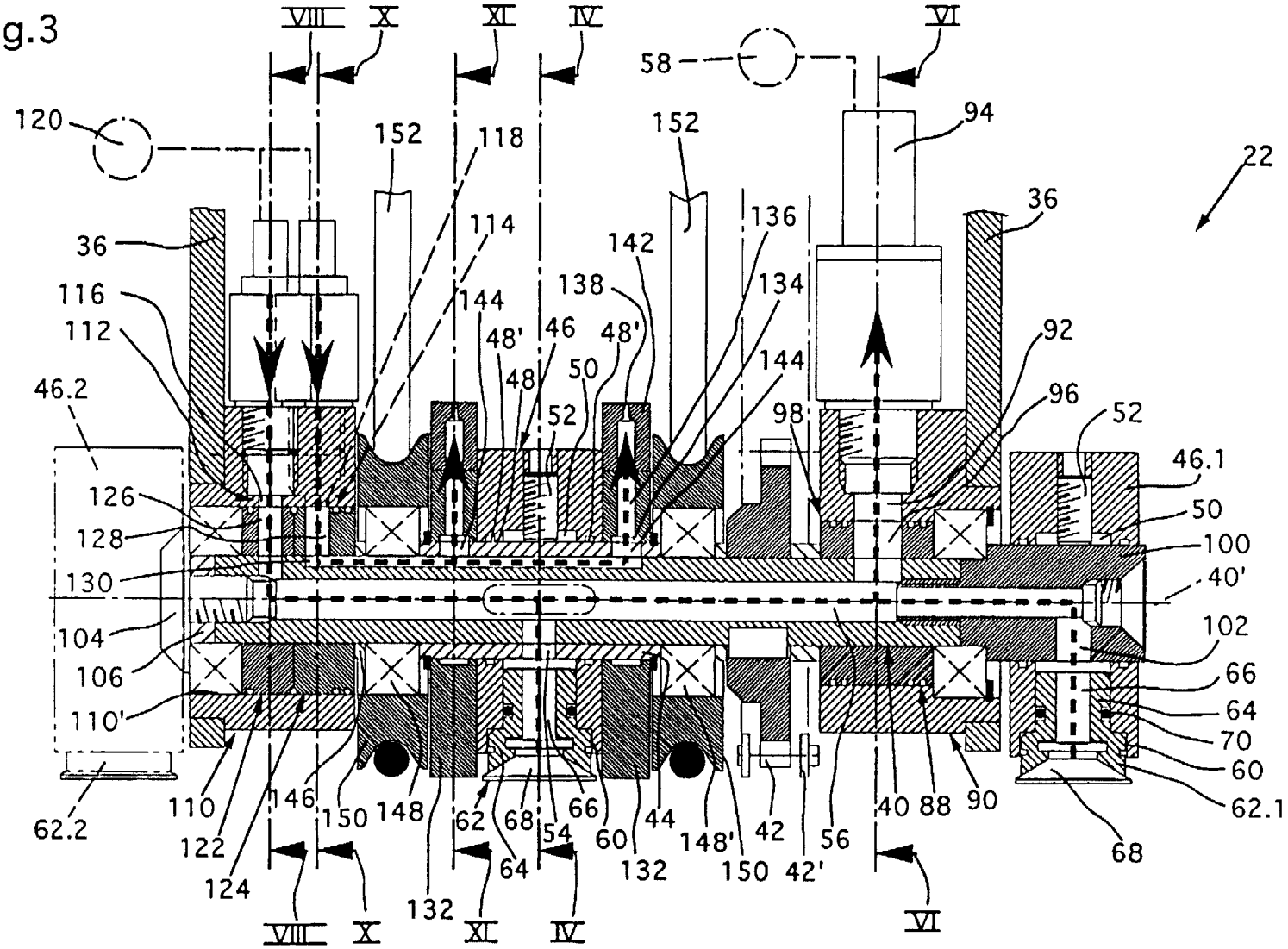
FIG. 3 shows a cross-sectional view of the device for opening the printed products of FIG. 1, taken along line III—III of FIG. 2.

Approximately centrally between the two bearing plates 36, a sleeve 44 is seated in a rotationally fixed manner on the hollow shaft 40, as shown in FIG. 3. A roller-like carrying body 46 is disposed around the sleeve 44. The carrying body 46 rests against the sleeve 44 by means of two sections 48' that are spaced apart from one another, with respect to the axial direction. The sections 48' are formed in the manner of a labyrinth seal and belong to the interior surface 48. The sections 48' bind an encircling groove 50 that is open in the direction of the sleeve 44. The carrying body 46 can be rotated with respect to the sleeve 44 and, in the desired rotational position, can be fixed on the sleeve 44 with a radial screw 52. The hollow shaft 40 and sleeve 44 have a radial connection opening 54 to connect the groove 50 to the cavity of the hollow shaft 40 in terms of flow. The cavity and the connection opening 54 form part of a flow duct 56. Depending on the rotational position of the hollow shaft 40, the flow duct 56 may be connected to a schematically indicated negative-pressure source 58.

The carrying body 46 includes a radially cylindrical receiving recess 60 that opens into the groove 50. A suction head 62, designed as an adapter, is inserted into the receiving recess 60 from the outside. The suction head 62 includes a suction-head body 64 that is shaped correspondingly to the receiving recess 60 and has a through-passage 66. When the suction-head body 64 is inserted into the carrying body 46, the through-passage 66 runs in the radial direction and is in communication with the groove 50. A sucker element 68 consisting of elastomeric material is inserted into a radially outer end section of the through-passage 66. The sucker element has a lip that is shaped similar to the lateral surface of a truncated cone and projects in the radial direction beyond the carrying body 46 and suction-head body 64. The frustoconical opening, around which the lip grips, is in communication with the through-passage 66.

Figure 4:
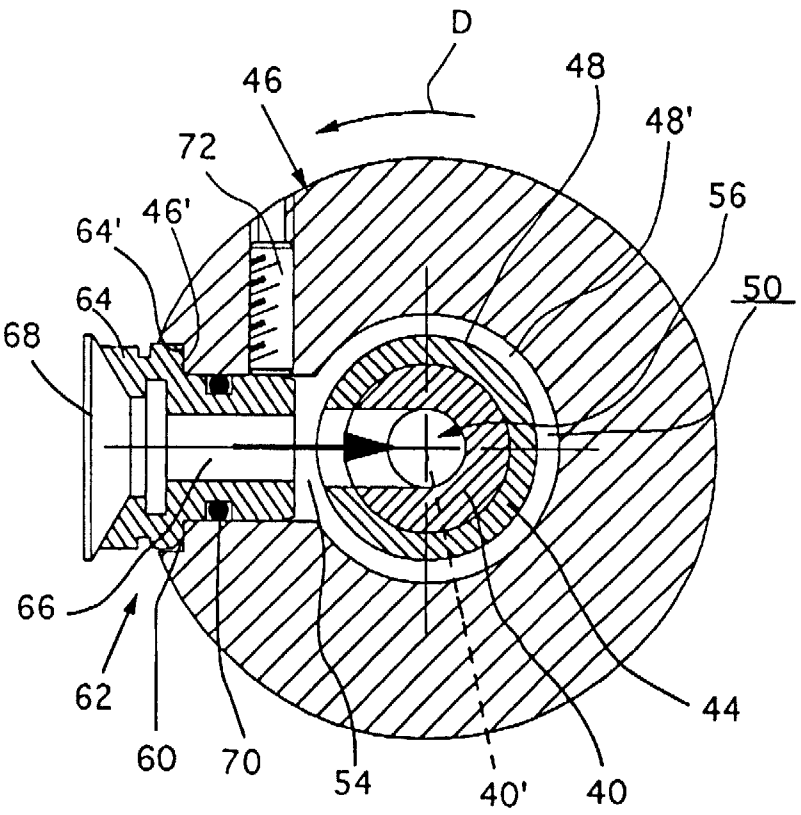
FIG. 4 shows a cross-sectional view of the device for opening the printed products of FIG. 1, taken along line IV—IV of FIG. 3, with a suction head inserted into a carrying body.

The suction-head body 64 also includes an outer circumferential groove into which an O-ring 70 is inserted for sealing any possible gap between the carrying body 46 and the suction-head body 64. As shown in FIG. 4, the suction-head body 64 is retained by a screw 72 that is screwed into the carrying body 46.

Figure 5:
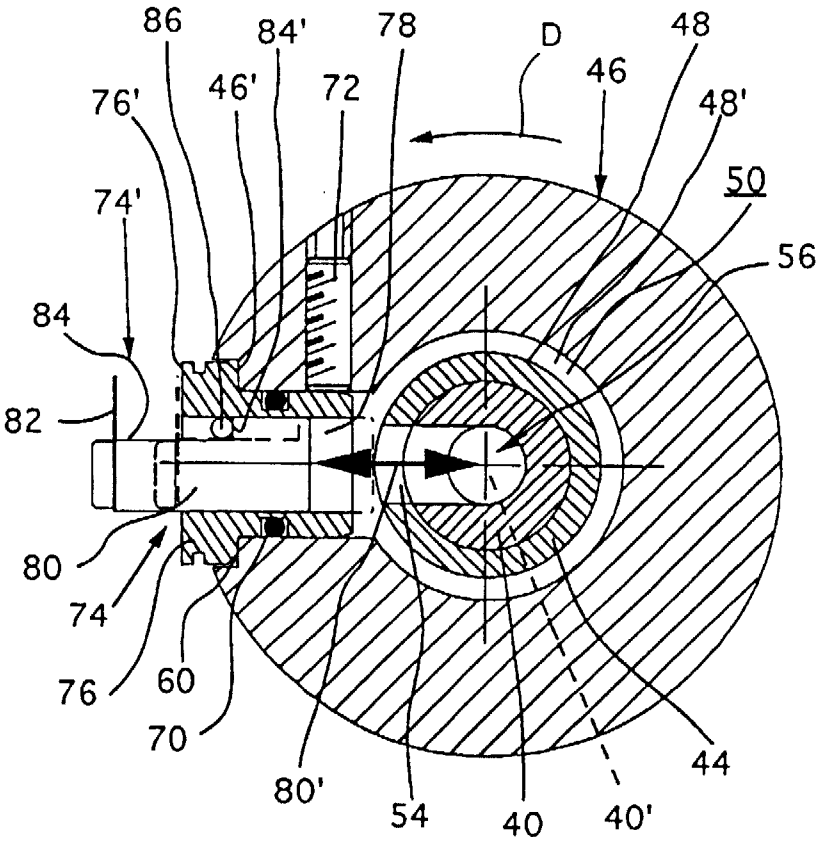
FIG.5 shows a cross-sectional view of the device for opening the printed products of FIG. 1, taken along line IV—IV of FIG. 3, with a gripper inserted into the carrying body.

As shown in FIG. 5, a gripper 74, designed as an adapter, may be inserted into the receiving recess 60 of the carrying body 46 instead of the suction head 62. The gripper 74 includes a gripper body 76 that fits into the receiving recess 60 and has a radially cylindrical through-passage 78. When the gripper is inserted into the carrying body, the through-passage 78 runs in the radial direction with respect to the longitudinal axis 40' and is of a constant cross-section. A piston 80 is guided in the cylindrical through-passage 78 such that it can be displaced back and forth in the radial direction, as is indicated by the double arrow 80'. A gripper tongue 82 is fastened at the outer end of the piston 80 and projects beyond the gripper body 76. The gripper tongue 82 projects from the piston 80 counter to the direction of rotation D. The gripper tongue 82, together with a radially outer end plane 76' of the gripper body 76, forms a gripper jaw 74'. The base of the gripper jaw 74' is formed by a stop plane 84 that is integrally formed on the otherwise cylindrical piston 80 and extends into the cylindrical through-passage 78. A pin 86 is inserted into the cavity between the gripper body 76 and the stop plane 84. The pin secures the piston 80, and thus the gripper tongue 82, against rotation. In addition, the pin forms a boundary with a stop surface 84' bordering the radially inner end of the stop plane 84. The boundary formed by the pin 86 and the stop surface 84' prevents movement of the piston 80 in the radial direction towards the outside. This establishes the open position of the gripper 74, shown by solid lines.

Chain-dotted lines indicate the closed position of the gripper 74, that the piston 80 and the gripper tongue 82 assume when the flow duct 56 is connected to the negative-pressure source 58. Similar to the suction head 62, the gripper body 76 also includes an encircling groove with an 0-ring 70 disposed in the grooves, and the gripper 74 is retained in the carrying body 46 by the screw 72. It is readily apparent from FIGS. 4 and 5 that the suction head 62 can be exchanged for a gripper 74, and vice versa, simply by releasing the screw 72.

Figure 6:
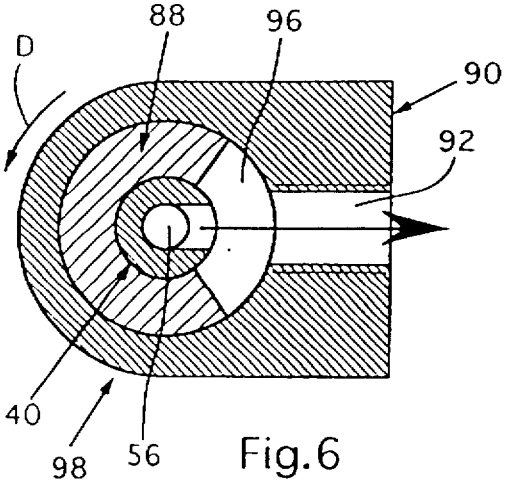
FIG. 6 shows a cross-sectional view of a suction valve of the device for opening the printed products of FIG. 1, taken along line VI—VI of FIG. 3.

As shown in FIG. 3, a roller-like valve body 88 is disposed in a rotationally fixed manner at one end of the hollow shaft 40. The roller-like valve body 88 is also mounted in a freely rotatable manner in a valve-seat element 90. The valve-seat element 90 includes a valve-seat opening 92 that runs in the radial direction with respect to the longitudinal axis 40'. The valve-seat opening 92 is connected to the negative-pressure source 58 through a line 94. Depending on the rotational position of the hollow shaft 40, the valve-seat opening 92 is closed by the valve body 88 or is connected, through a valve opening 96 in the valve body 88, to the cavity of the hollow shaft 40, and thus to the flow duct 56. As can be seen in FIG. 6, the valve opening 96 extends in a circumferential direction over a predetermined angular range of, for example, between 90° and 120°.

Figure 7:
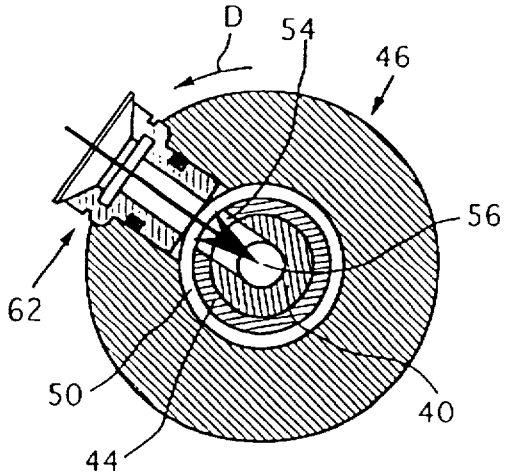
FIG. 7 shows a cross-sectional view of the carrying body with inserted suction head of FIG. 4, in a rotational position which corresponds to the rotational position of the suction valve according to FIG. 6, taken along line IV—IV of FIG. 3.

The valve body 88 and the valve-seat element 90 form a suction valve 98. As shown in FIG. 7, the suction valve connects the flow duct 56 to the negative-pressure source 58 in a specific rotational range.

The valve-seat element 90 is fastened on the associated bearing plate 36 and forms a bearing block for the hollow shaft 40. A shaft extension 100 is screwed on at this end of the hollow shaft 40. A carrying body 46.1 with a suction head 62.1 is seated on the shaft extension 100. The carrying body and suction head are of exactly the same design as the carrying body 46 and suction head 62, respectively. A flow line 102 is formed in the shaft extension 100 in order to connect the suction head 62.1 to the cavity of the hollow shaft 40, and thus to the flow duct 56. In the event of two suction heads and/or grippers not being used, the shaft extension 100 can be removed from the hollow shaft 40 and the hollow shaft 40 can be closed off on this side by means of a screw 104 and a shaft ring 106, as shown in FIG. 3. As is indicated in FIG. 3 by chain-dotted lines, a shaft extension that bears a further carrying body 46.2 with a suction head 62.2 can be fitted in a corresponding manner if necessary.

Serving as a bearing block on the other side for the hollow shaft 40 is a further valve-seat element 110 fastened on the associated bearing plate 36. The valve-seat element 110 forms the valve seats for a positive-pressure control valve 112 and a blowing valve 114. The valve-seat element 110 includes a valve-seat opening 116, assigned to the positive-pressure control valve 112, and a blowing valve-seat opening 118 assigned to the blowing valve 114. The valve-seat openings 116 and 118 are connected to a positive-pressure source 120. The valve-seat opening 116 interacts with a valve body 122, assigned to the positive-pressure control valve 112. The blowing valve-seat opening 118 interacts with a blowing-valve body 124, assigned to the blowing valve 114. The valve bodies 122 and 124 are designed in the manner of rollers and are seated on the hollow shaft 40. The valve bodies 122 and 124 are also arranged in a cylindrical through-passage 110' of the valve-seat element 110 such that they can be rotated about the longitudinal axis 40'. In addition, the valve bodies include annular grooves that run around their exterior surfaces and form a labyrinth seal with the wall of the through-passage 110'.

Figure 8:
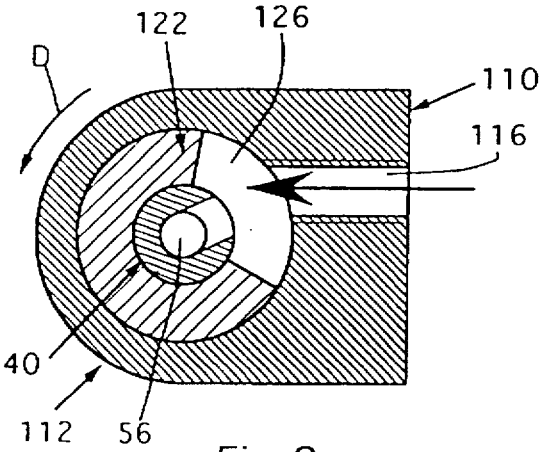
FIG. 8 shows a cross-sectional view of a positive-pressure control valve of the device for opening the printed products of FIG. 1, taken along line VIII-VIII of FIG. 3.
Figure 9:
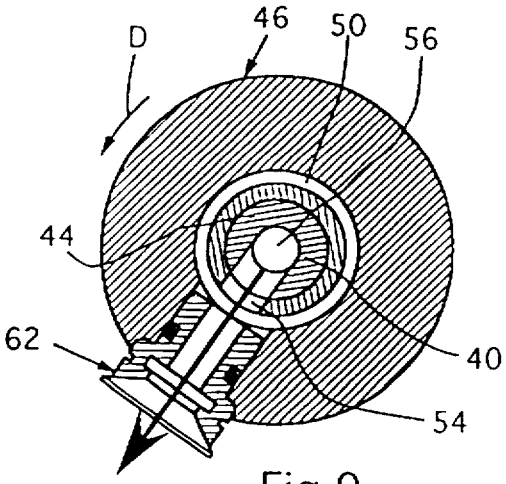
FIG. 9 shows a cross-sectional view of the carrying body with inserted suction head of FIG. 4, in a rotational position which corresponds to the rotational position of the positive-pressure control valve according to FIG. 8, taken along line IV—IV of FIG. 3.

As can be seen in FIG. 8, the valve body 122 includes a valve opening 126. On the inside, the valve opening 126 is in communication with the cavity of the hollow shaft 40. On the outside, the valve opening 126 extends in the circumferential direction over a predetermined region of, for example, between 90° and 120°. As shown in FIG. 9, the positive-pressure control valve 122 connects the flow duct 56, and thus the suction head 62 or gripper 74, to the positive-pressure source 120 over a specific rotational range of the hollow shaft 40. As can be seen by comparing FIGS. 6 and 7 with FIGS. 8 and 9, the valve body 88 of the suction valve 98 is arranged with respect to the valve body 122 of the positive-pressure control valve 112 such that the valve opening 96 of the valve body 88 precedes the valve opening 126 of the valve body 122 with respect to the direction of rotation D. However, the two valve openings 96 and 126 overlap to some extent. In the course of a rotation of the hollow shaft 40, the flow duct 56 is thus connected first of all only to the negative-pressure source 58, then to the negative-pressure source and the positive-pressure source 120, and subsequently only to the positive-pressure source. In a rotational range of approximately 150°, the flow duct 56 is thus cut off from both the negative-pressure source 58 and the positive-pressure source 120, and is closed with respect to the valve.

Figure 10:
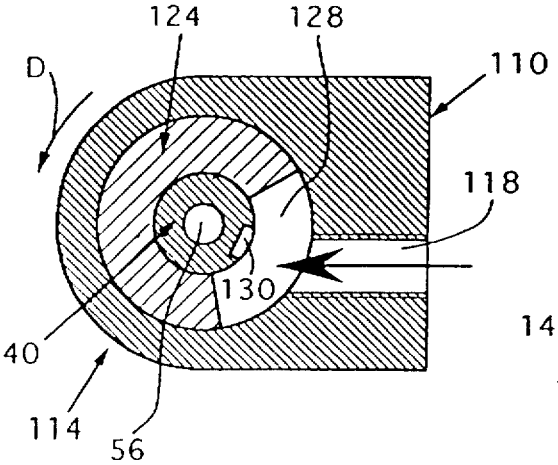
FIG. 10 shows a cross-sectional view of a blowing valve of the device for opening the printed products of FIG. 1, taken along line X—X of FIG. 3.

As shown in FIG. 10, the blowing-valve body 124 includes a blowing-valve opening 128 that, radially towards the inside, is in communication with a longitudinal groove 130 of the hollow shaft 40. The blowing-valve opening 128 also extends, radially towards the outside, over a region that corresponds approximately to the region of the valve opening 126 of the positive-pressure control valve 112, with respect to the circumferential direction. The valve opening 126 leads the blowing-valve opening 128, with respect to the direction of rotation D, but they overlap over a considerable extent, preferably 50 and 90%.

Figure 11:
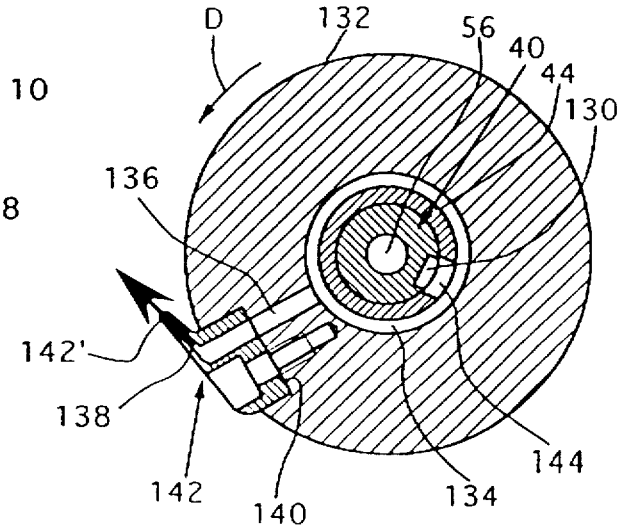
FIG. 11 shows a cross-sectional view of a blowing-nozzle arrangement of the device for opening printed products of FIG. 1, taken along line XI—XI of FIG. 3.

As can be seen in FIG. 3, a blowing-nozzle carrying disc 132 is seated in a rotationally fixed manner on the sleeve 44 on both sides of the carrying body 46. As can also be seen from FIG. 11, each of these blowing-nozzle carrying discs 132 includes, radially towards the inside, an encircling connecting groove 134 that is open towards the sleeve 44. Each of the blowing-nozzle carrying discs 132 also includes a blowing duct 136 that extends in the radial direction and is connected to a blowing nozzle 138 of a blowing-nozzle body 142. The blowing-nozzle body 142 is inserted into a recess 140 in the blowing-nozzle carrying disc 132. The blowing nozzle 138 is directed counter to the direction of rotation D. The sleeve 44 includes two radial through-passages 144 that connect the connecting grooves 134 to a longitudinal groove 130. The longitudinal groove 130 extends, in the direction of the longitudinal axis 40', from the blowing-valve body 124 to the blowing-nozzle carrying disc 132 at a distance away from the blowing-valve body 124. In the region between the blowing-valve body 124 and the sleeve 44, the longitudinal groove 130 is covered over by a spacer disc 146 and a ball bearing 148.

Figure 2:
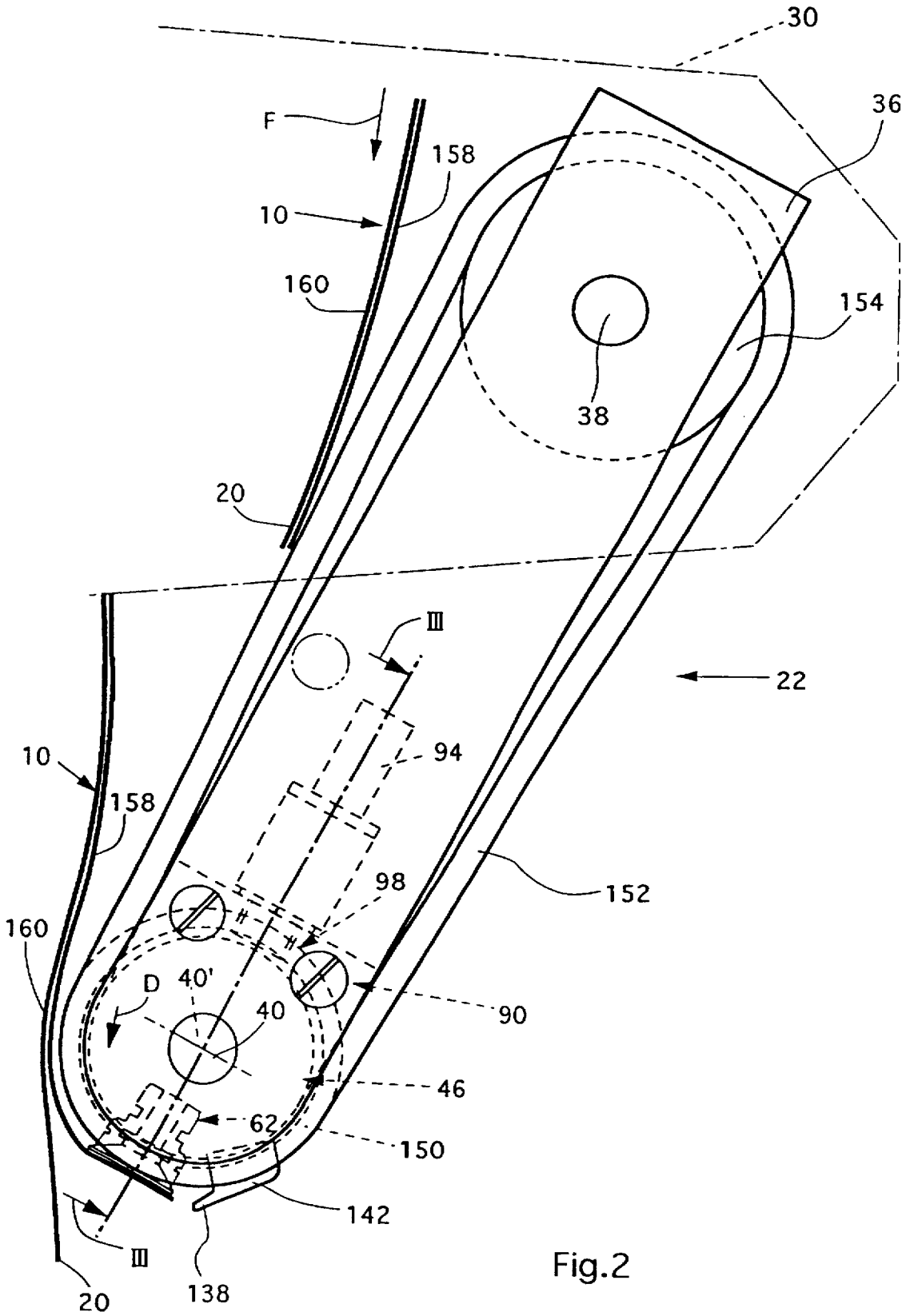
FIG. 2 shows the device for opening the printed products of FIG. 1.

A deflection wheel 150 is seated on the ball bearing 148 and another deflection wheel 150 is seated on a further ball bearing 148'. The ball bearing 148' is seated on the hollow shaft 40 on the other side of the carrier 30. As shown in FIG. 2, two endless rubber bands 152 are guided around corresponding drive wheels 154 that are seated in a rotationally fixed manner on the drive shaft 38. The rubber bands 152 are intended for guiding, with respect to the conveying direction F, the leading edge 20 of the printed products 10 fed to the opening device 22 by the conveying device 12.

As can be seen in FIGS. 2 and 12 to 14, the carrying body 46 is arranged with respect to the hollow shaft 40 such that the suction head 62 follows the blowing-nozzle body 142 at a short distance with respect to the direction of rotation D. As a result, an air jet 156 emerging from the blowing nozzle 138 (FIGS. 13 and 14) blows past the suction head 62 approximately tangentially with respect to the suction head 62.

As shown in FIGS. 15–20, if a gripper 74 is inserted into the carrying body 46, the gripper is moved into a position with respect to the hollow shaft 40 such that the gripper jaw 74' is located at least approximately at the blowing nozzle 138 with respect to the circumferential direction. In order to prevent the printed products 10 from being obstructed by the blowing-nozzle body 142, the blowing-nozzle body includes a nozzle nose 142' that projects counter to both the direction of rotation D and the direction that the blowing nozzle 138 runs.

The operation of the opening device 22 shown in FIGS. 1 to 11 will now be described with reference to FIGS. 12 to 20. FIGS. 12 to 20 show the carrying body 46 seated on the hollow shaft 40 with a suction head 62 or gripper 74 inserted in the carrying body. The blowing-nozzle body 142, the air jet 156, the active strand of the rubber band 152, and the printed product 10 that is to be opened are also indicated.

Figure 12:
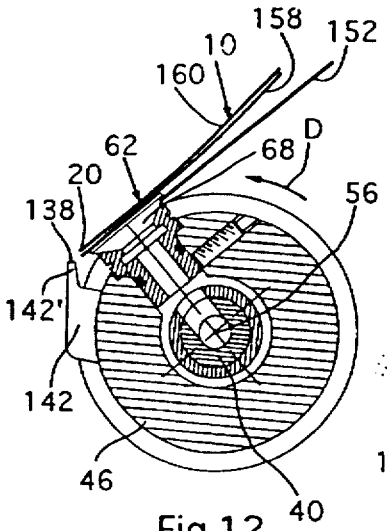
FIGS. 12 to 14 show a cross-sectional view of the device for opening the printed products of FIG. 1, with a suction head inserted into a carrying body at three different points in time during an opening operation, taken along line IV—IV of FIG. 3.
Figure 13:
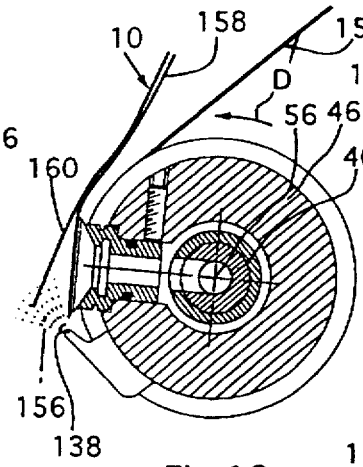
Figure 14:
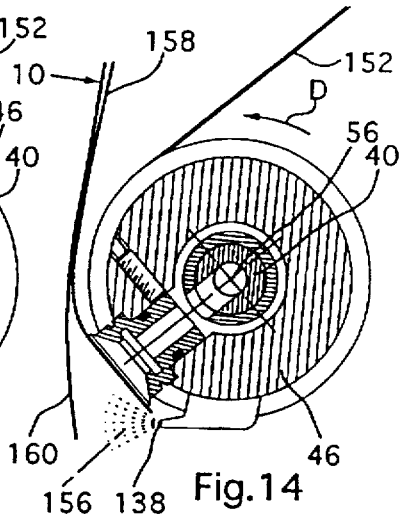

FIGS. 12 to 14 show the opening operation of a printed product 10 that comprises a centrally folded sheet with two leaves. The printed product 10 is retained at the fold 18 by a transporting clamp 14 (shown in FIGS. 1 and 2) and is fed to the opening device 22. The front edge 20, located opposite the fold 18, and a first product part 158, facing the opening device 22, come to rest against the supporting strand of the rubber band 152 by its region adjoining the edge 20. The rubber band 152 is preferably driven in the direction of rotation D at a greater speed than the corresponding transporting clamp 14. The hollow shaft 40 is likewise driven in the direction of rotation D such that the rotational speed of the sucker element 68 is slightly lower than the speed of the corresponding transporting clamp 14. The hollow shaft 40 is synchronized with the conveying device 12 such that the sucker element 68 comes to rest against the outer side of the first product part 158 in a region adjoining the edge 20, as shown by FIG. 12. In this arrangement, the longitudinal direction of the suction head 62 runs essentially at right angles with respect to the active strand of the rubber band 152.

The flow duct 56, previously cut off from both the negative-pressure source and the positive-pressure source 58, 120, is then connected to the negative-pressure source 58 by the suction valve 98 being opened, as indicated by an arrow in FIGS. 6 and 7. As a result, the suction head 62 secures the first product part 158 by suction. In the course of further rotation of the hollow shaft 40, the first product part 158 is then retained and bent on account of the circular movement path of the sucker element 68. As a result, the second product part 160, on account of its inherent stability, begins to lift off from the first product part 158. As seen in FIG. 13, this lifting-off operation is assisted by the air jet 156, when the blowing valve 114 opens after the suction head 62 has secured the first product part 158 by suction.

In the course of further rotation of the hollow shaft 40, the opening between the two product parts 158 and 160 increases, as shown in FIG. 14. As can be seen from FIG. 1, a saddle-like rest 26 of the processing station 24 then runs between the first product part 158, retained by the suction head 62, and the second product part 160, that is at least partially lifted off from the first product part 158. The rest 26 carries the printed product 10 along in the direction of rotation U. Approximately simultaneously, the positive-pressure control valve 112 is opened. As a result, the positive pressure is then built up in the flow duct 56 and the suction head 62 is rapidly provided with air, as shown in FIGS. 8 and 9. The second product part 160 and the now released first product part 158 grip around the relevant rest 26 from above. The printed product 10 is then transferred by the transporting clamp 14 being opened, onto the saddle-like rest 26 in a straddling manner. Approximately at the same time that the flow duct 56 is provided with air, the blowing valve 114 closes. Shortly after the flow duct is provided with air, the suction valve 98 also closes. The positive-pressure control valve 112 subsequently also closes after approximately a 1800 rotation of the hollow shaft 40 from when the first product part 158 was seized. On account of further rotation of the hollow shaft 40, the suction head 62 comes to rest against the first product part 158 of the next printed product 10 that is to be opened.

Figure 15:
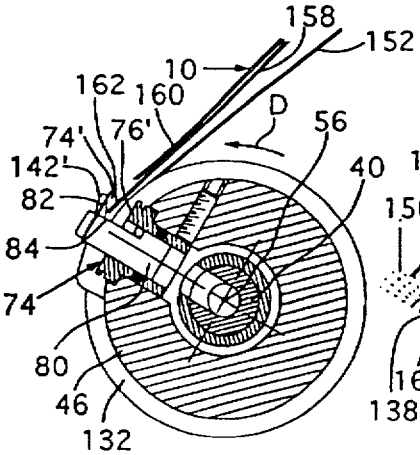
FIGS. 15 to 17 show a cross-sectional view of the device for opening printed products of FIG. 1, taken along line IV—IV of FIG. 3, with a gripper inserted into a carrying body at three different points in time during an opening operation. The product part that is to be seized by the gripper includes a border section that projects beyond the other product part of the printed products
Figure 16:
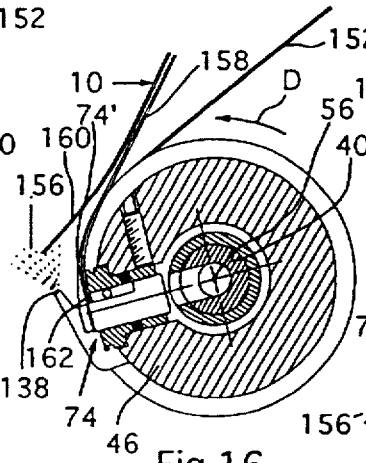
Figure 17:
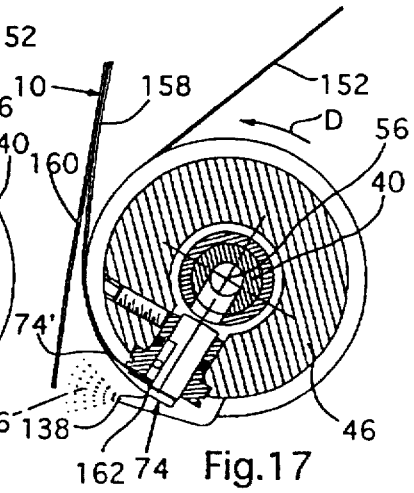

FIGS. 15 to 17 show a printed product 10 that is folded in an off-center manner with the first product part 158 having a border region 162 that projects beyond the second product part 160. In order to process such, preferably multiple-leaf, printed products 10, a gripper 74 is inserted into the carrying body 46 instead of the suction head 62. Furthermore, the carrying body 46 is positioned on the hollow shaft 40 such that the gripper jaw 74' and the blowing nozzle 138 are approximately in alignment with one another, with respect to the direction of the longitudinal axis 40'. Adjustment of the valve bodies 88, 122, and 124 is not necessary. If necessary, it is possible to adapt the phase position between the conveying device 12 and the hollow shaft 40.

The printed products 10 are retained by the transporting clamps 14 such that the first product part 158 and the border region 162 come to rest against the rubber band 152, as shown in FIG. 15. Since the circumferential speed of the gripper 74 is lower than the transporting speed of the printed product 10, the border region 162 runs into the gripper jaw 74' of the opened gripper 74 and comes to rest against the stop plane 84 by means of its edge 20. As can be seen in FIG. 15, the border region 162 runs between the blowing-nozzle nose 142' and the blowing-nozzle carrying disc 132. The flow duct 56, that was closed and previously cut off from both the negative-pressure source and the positive-pressure source 58, 120, is then connected to the negative-pressure source 58 by the suction valve 98 being opened. As a result, the piston 80 is drawn inwards in the radial direction and, consequently, the gripper jaw 74' is closed. The border region 162 is thus held clamped between the gripper tongue 82 and the end plane 76'. In the course of further rotation of the hollow shaft 40 in arrow direction D, the first product part 158 is bent around the carrying body 46. As a result, the second product part 160 that is not retained by the gripper 74, begins to lift off from the first product part 158. As shown in FIG. 16, this lifting-off operation is assisted by the air jet 156 when the blowing valve 114 is opened after the gripper 74 is closed. Upon further rotation of the hollow shaft 40, the opening between the two product parts 158 and 160 is increased, as shown in FIG. 17. In the same manner described above, a rest 26 of the processing station 24 then runs between the product parts 158 and 160 that have been lifted off from one another. Thereafter, the positive-pressure control valve 112 is opened and positive pressure is produced in the flow duct 56. The piston 80 is then pushed outwards in the radial direction until its stop surface 84' rests against the pin 86 and the gripper jaw 74' is opened to the full extent. Next, the blowing valve 114 and then the positive-pressure control valve 112 are closed after approximately a rotation of 180° of the hollow shaft 40 from when the gripper 74 was closed. Since the flow duct 56 is then closed, the gripper 74 is retained in the open until it is again connected to the negative-pressure source 58 for closure of the gripper 74.

Figure 18:
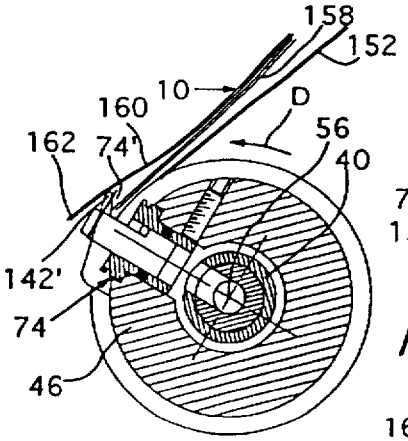
FIGS. 18 to 20 show a cross-sectional view of the device for opening the printed products of FIG. 1, taken along line IV—IV of FIG. 3, with a gripper inserted into a carrying body at three different points in time during an opening operation. One product part having a border section that projects beyond the product part that is to be seized by the gripper.
Figure 19:
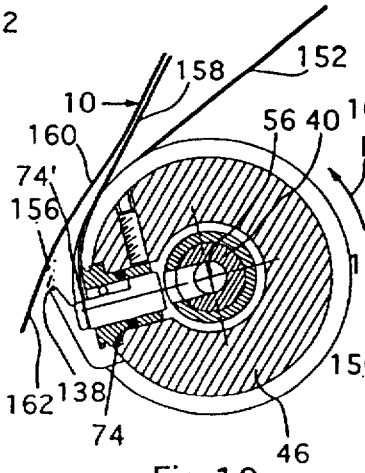
Figure 20:
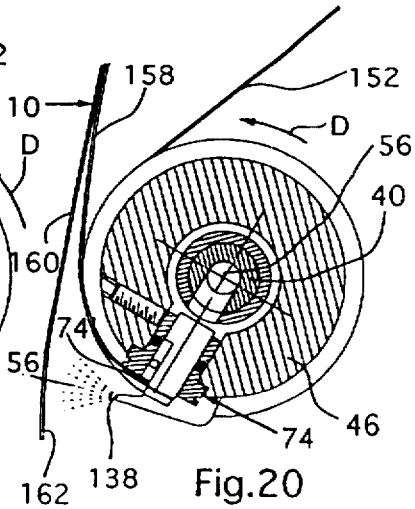

FIGS. 18 to 20 show a printed product 10 that is folded in an off-center manner and retained by the transporting clamps 14 such that the first product part 158 coming to rest against the rubber band 152 is shorter than the second product part 160. The second product part 160 now has the projecting border region 162, as shown in FIG. 18. In order to process these printed products, the gripper 74 engages beneath the border region 162 and lifts the second product part 160. On account of the relative speed between the printed product 10 and the gripper 74, the first product part 158 runs into the opened gripper jaw 74'. The gripper jaw 74' is then closed by the suction valve 98 being opened, as shown in FIG. 19. Shortly after this, the blowing valve 114 is opened and the air jet 156 assists the lifting operation of the second product part 160 off from the retained first product part 158. In the course of further rotation of the hollow shaft 40, this opening is increased, as shown in FIG. 20. Once again, after a rest 26 has been moved in between the product parts 158, 160, opening of the positive-pressure control valve 112 opens the gripper jaw 74' and releases the first product part 158. Shortly after this, the suction valve 98, followed by the blowing valve 114, and finally the positive-pressure control valve 112, are closed. The opening device 22 is then ready for opening the next printed product 10.

Of course, it is also possible to close the suction valve 98 before the positive-pressure control valve 112 is opened in each of the above embodiments. It is likewise conceivable to arrange the valve bodies in an adjustable manner on the hollow shaft 40 in order to individually set the times at which the valves open and close. In addition, it is not absolutely necessary for blowing nozzles 138 and a blowing valve 114 to be present.

It is also conceivable to provide only one negative-pressure source 58, but no positive-pressure source 120, and to use the ambient air for the purpose of providing the flow duct 56 with air. In this embodiment, the piston 80 can be prestressed, for example, by a spring, in the direction of the open position of the gripper jaw 74'. It is also conceivable to use, as a negative-pressure source, an injector pump that is connected to a positive-pressure source and/or can be connected via a valve.

It should also be mentioned that it may be advantageous to drive the hollow shaft 40 at a variable rotational speed in order to ensure that the first product part 158 runs reliably into the opened gripper 74. This rotational speed may also be varied to cause additional bending in the printed products 10 for assisting the opening operation. If use is made of a conveying device 12 such as that disclosed in CH Patent Application No. 02 667/94-2, the same effect can be achieved by controlling the transporting clamps 14.

Of course, the conveying device may be of a different design. It can be readily appreciated that the carrying body, the suction head, and the gripper may be designed differently from the form depicted. The essential feature is that the suction head and the gripper can be exchanged in the manner of an adapter and are mutually interchangeable.

I claim:

1. A device for opening printed products comprising:

a carrying body rotatable about an axis, the carrying body having a first and a second rotational position;

a flow duct subjected to pneumatic pressure for the first rotational position of the carrying body; and a suction head removably connectable to the carrying body and connected to the flow duct; and a pnuematically controllable gripper also removably connectable to the carrying body and connected to the flow duct.

2. The device according to claim 1 wherein the flow duct further comprises a connection opening connected to the suction head and the gripper.

3. The device according to claim 2 wherein the carrying body further comprises a receiving recess to receive the suction head and the gripper, the receiving recess being in communication with the connection opening of the flow duct.

4. The device according to claim 3 wherein the suction head comprises a suction-head body mounted in the receiving recess, the suction-head body having a sucker element and a through-passage in communication with both the connection opening and the sucker element.

5. The device according to claim 3 wherein the pneumatically controllable gripper comprises a gripper body disposed in the receiving recess, a cylindrical through-passage in communication with the connection opening, and a moveable piston disposed in the cylindrical through-passage, the moveable piston having a gripper tongue.

6. The device according to claim 1 further comprising a valve arrangement to connect the flow duct to a negative-pressure source when the carrying body is in the first rotational position, and to connect the flow duct to a positive-pressure source when the carrying body is in the second rotational position.

7. The device according to claim 6 wherein the valve arrangement includes a suction valve connected to the negative-pressure source, the suction valve having a valve-seat element and a valve body disposed in the valve-seat element and in communication with the carrying body, and a positive-pressure control valve connected to the positive-pressure source, the positive-pressure control valve having a valve-seat element and a valve body disposed in the valve-seat element and in communication with the carrying body.

8. The device according to claim 7 wherein the carrying body and the valve bodies of the suction valve and positive-pressure control valve are seated on a shaft rotatably driven about the axis of rotation for the carrying body, the valve bodies have valve openings in communication with the flow duct, the valve-seat element of the suction valve has a valve-seat opening connected to the negative-pressure source, and the valve-seat element of the positive-pressure control valve has a valve-seat opening connected to the positive-pressure source, the valve openings being capable of communication with the valve-seat openings.

9. The device according to claim 8 wherein the position of the carrying body is adjustable with respect to the shaft in the circumferential direction.

10. The device according to claim 1, further comprising a blowing nozzle rotatable with the carrying body and in communication with a positive-pressure source, the blowing nozzle having an air jet for assisting the opening of the printed products.

11. The device according to claim 10, further comprising a blowing valve having a blowing-valve body rotatable with the carrying body, the blowing-valve also having a blowing-valve opening connected to the blowing nozzle, and a valve-seat element having a blowing-valve-seat opening in communication with the positive-pressure source, the blowing-valve opening being in communication with the blowing-valve-seat opening.

12. A device for opening printed products comprising:

a carrying body rotatable about an axis, the carrying body having a first and a second rotational position;

a flow duct subjected to pneumatic pressure for the first rotational position of the carrying body; and an adapter removably connectable to the carrying body and connected to the flow duct, the adapter being one of a suction head and a pneumatically controllable gripper, the suction head and the pneumatically controllable gripper being interchangeable with each other.

13. A device for opening printed products comprising:

a carrying body rotatable about an axis, the carrying body having a first and a second rotational position;

a flow duct subjected to pneumatic pressure for the first rotational position of the carrying body; and a pneumatically controlled gripper removably connectable to the carrying body and connected to the flow duct;

wherein the gripper is interchangeable with a suction head.

* * * * *